US005135137A

United States Patent [19]

Rudick

[11] Patent Number: 5,135,137

[45] Date of Patent: Aug. 4, 1992

[54] SIMPLIFIED MICRO-GRAVITY PRE-MIX PACKAGE

[75] Inventor: Arthur G. Rudick, Marietta, Ga.

[73] Assignee: The Coca-Cola Company, Atlanta, Ga.

[21] Appl. No.: 642,448

[22] Filed: Jan. 17, 1991

[51] Int. Cl.[5] ..... B67B 7/00

[52] U.S. Cl. ..... 222/1; 222/105; 222/484; 141/2

[58] Field of Search ..... 222/1, 105, 397, 484, 222/95, 482; 141/18, 29, 2

[56] References Cited

U.S. PATENT DOCUMENTS

| | | | |
|---|---|---|---|
| 3,011,686 | 12/1961 | Rockwell . | |
| 3,074,602 | 1/1963 | Shillady et al. . | |
| 3,283,960 | 11/1966 | Williams . | |
| 3,415,425 | 12/1968 | Knight et al. . | |
| 4,162,030 | 7/1979 | Capra et al. . | |
| 4,346,743 | 8/1982 | Miller . | |
| 4,709,734 | 12/1987 | Rudick et al. . | |
| 4,752,018 | 6/1988 | Rudick et al. . | |
| 4,785,974 | 11/1988 | Rudick et al. | 222/105 |
| 4,801,046 | 1/1989 | Miczka | 222/95 |
| 4,802,610 | 2/1989 | Cheek et al. | 222/484 X |
| 4,807,785 | 2/1989 | Pritchett | 222/484 X |
| 4,875,508 | 10/1989 | Burke, II et al. | 222/95 X |
| 4,892,230 | 1/1990 | Lynn, Jr. | 222/484 X |
| 5,012,956 | 5/1991 | Stoody | 222/95 X |

*Primary Examiner*—Gregory L. Huson

[57] ABSTRACT

A package for dispensing a carbonated beverage pre-mix in the micro-gravity conditions of outer space comprises a rigid container, a collapsible bag affixed to the container, a valve in communication with the bag and a cap for enclosing the valve. Between the bag and rigid container, a space is defined in which pressurized gas is injected. The pressurized gas maintains the carbonation in solution during storage. Upon removal of the cap from the container, the pressurized gas is automatically vented from the space. The valve is then opened and the pre-mix can be sucked from the package by a consumer. An elastomeric spring in the valve will return the valve to a closed position when the valve is released and the cap may be replaced on the rigid container. While the pre-mix can be dispensed in the micro-gravity conditions of outer space, the package can be filled with the pre-mix on earth. First, the valve is opened and carbonated pre-mix is filled into the bag. The valve is then closed and the safety cap is screwed on the package. Finally, pressurized gas is injected in the space through a filling port which is then sealed.

20 Claims, 2 Drawing Sheets

SIMPLIFIED MICRO-GRAVITY PRE-MIX PACKAGE

BACKGROUND OF THE INVENTION

1. Field of the Invention

The present invention relates to a package for dispensing a carbonated beverage pre-mix in the micro-gravity conditions of outer space. The package includes a rigid container housing a collapsible bag having pressurized gas therebetween. Upon removal of a cap from the package, the pressurized gas is automatically vented.

2. Description of the Background Art

Various pre-mix packages are known in the art. For instance, U.S. Pat. No. 4,752,018 to Rudick et al discloses a micro-gravity pre-mix package. However, such packages are somewhat complicated and therefore more expensive to manufacture. Accordingly, a need in the art exists for a simple, low-cost, light weight alternative to current micro-gravity pre-mix packages.

In the zero or micro-gravity conditions of outer space, certain problems arise with carbonated beverages. For example, such beverages cannot be poured from a vessel directly into the consumer's mouth. They must either be forced out of the package or vessel, under pressure, or sucked therefrom directly into the mouth of the consumer or astronaut. For still beverages and water, the astronaut can suck the liquid from a collapsible container through a straw.

Furthermore, the container utilized for dispensing a food or beverage must be of a collapsible volume-type in order to preclude the creation of an air space or pocket within the container. The location of such an air space cannot be controlled due to the substantially zero gravity conditions. Due to the unique properties of carbonated beverages, a need in the art therefore exists for a mechanism which will properly dispense such beverages in the zero or micro-gravity conditions of outer space from a simplified package.

SUMMARY OF THE INVENTION

Accordingly, it is a primary object of the present invention to provide a package for dispensing a carbonated beverage pre-mix in the micro-gravity or zero gravity conditions of outer space as well as on earth.

It is another object of the present invention to provide a package for dispensing a carbonated beverage pre-mix which is simple to operate and light weight.

It is a further object of the present invention to provide a package for dispensing a carbonated beverage pre-mix which will reliably hold the pre-mix while avoiding accidental spillage.

Yet another object of the present invention is to provide a package for dispensing a carbonated beverage which can maintain the carbonation in solution during storage of the beverage.

It is another object of the present invention to provide a package for dispensing a carbonated beverage pre-mix which is simple and low cost to manufacture.

It is yet another object of the present invention to provide a method for filling the package with carbonated beverage pre-mix and providing an easy method for consuming the carbonated beverage pre-mix from the package.

These and other objects of the present invention are fulfilled by providing a package for dispensing a carbonated beverage pre-mix having a rigid container with a collapsible bag disposed therein. The pre-mix is placed in the bag and between the bag and rigid container is a space. Within the space, pressurized gas is injected for maintaining the carbonation in solution. A valve is provided for filling and removing pre-mix from the collapsible bag. The valve is enclosed by a cap which seals a passageway for venting the gas. Upon removal of the cap, the pressurized gas is automatically vented. The valve can then be moved to an open position to allow the consumer to suck the pre-mix out of the package. If some pre-mix remains within the package, release of the valve automatically returns the valve to the closed position. To ensure that the valve is not inadvertently open, the safety cap may be replaced.

The method for filling the package utilizes the steps of filling the collapsible bag with pre-mix through the valve. Once the bag is filled, the valve is released and automatically closed. The cap is then screwed onto the rigid container closing a gas vent from the rigid container. Gas under pressure is injected into the space between the bag and rigid container through a filling port. Once this space is filled with pressurized gas, the filling port is closed and the package is ready for a consumer.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
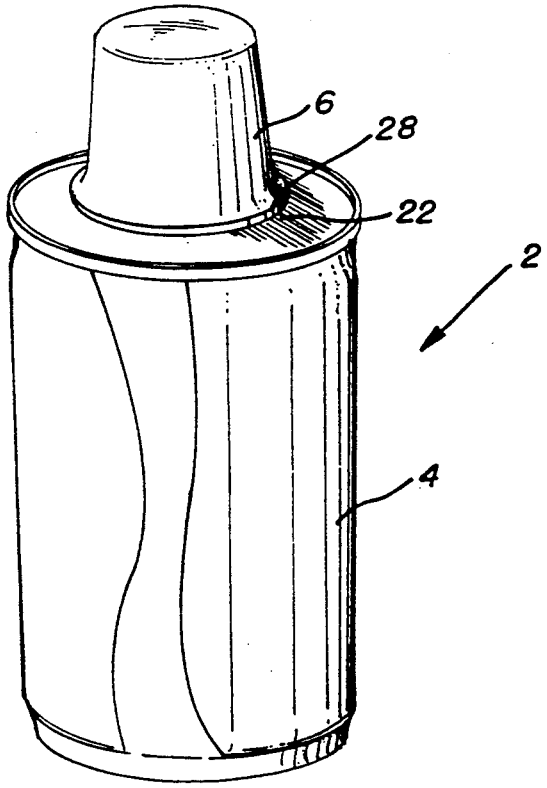
FIG. 1 is a front perspective view illustrating the package for dispensing a carbonated beverage pre-mix of the present invention.

Referring in detail to the drawings and with particular reference to FIG. 1, a package 2 for dispensing a carbonated beverage pre-mix is shown. This package includes an outer rigid container 4 having a safety cap 6 screwed thereon.

The rigid container 4 can be manufactured from metal, such as aluminum or rigid, high-impact plastic such as polycarbonate, nylon or the like. Container 4 may be a 12 oz. can, 2 liter larger 2 or 5-gallon container, or any suitable size.

Figure 2:
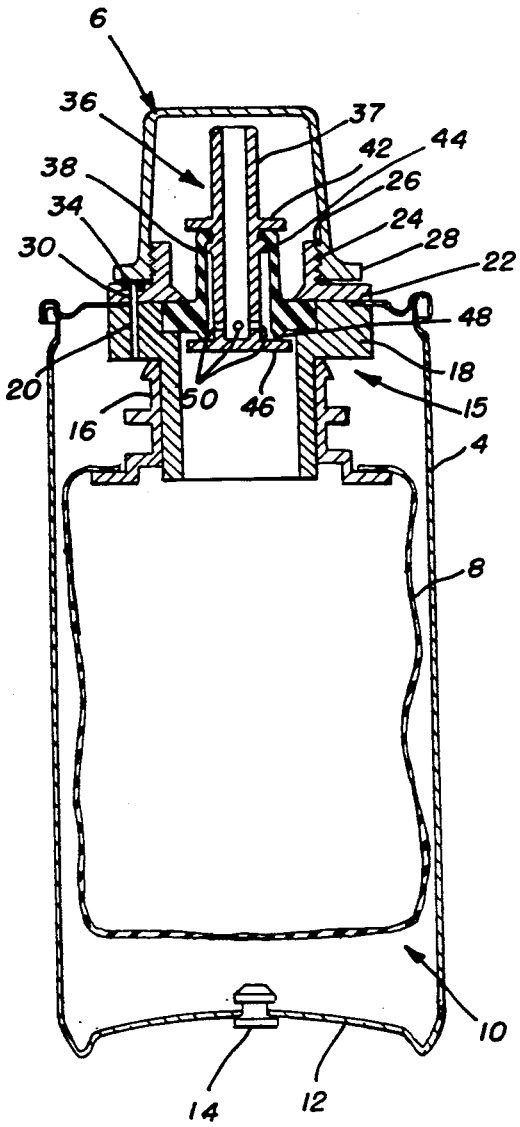
FIG. 2 is a cross-sectional view of the package of the instant invention with the cap on the rigid container and the valve in a closed position.
Figure 3:
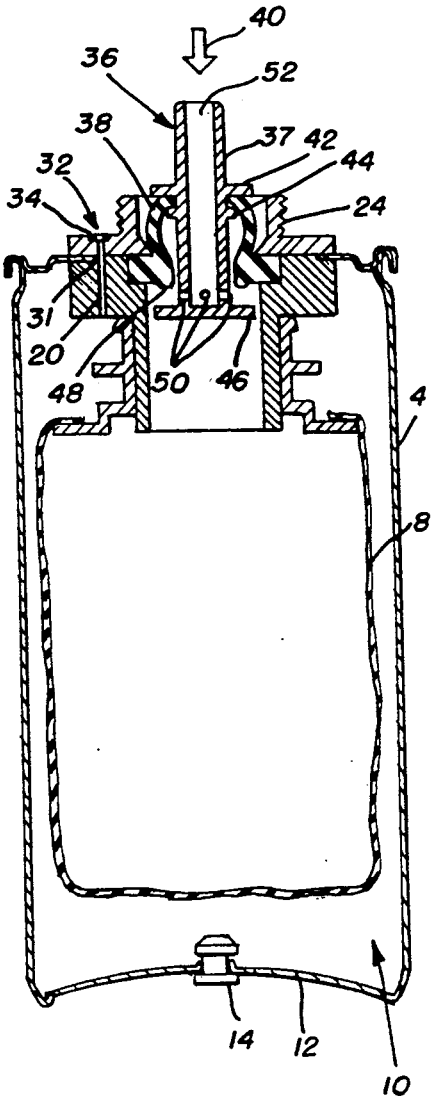
FIG. 3 is a cross-sectional view of the Package of the instant invention with the cap removed and the valve in an open position.

As best seen in FIGS. 2 and 3, within the rigid container 4 is a collapsible bag 8. This bag 8 holds the pre-mix. The collapsible bag 8 may be made from polyethylene, metalized polyester or the like. The filling of the collapsible bag 8 with the pre-mix will be discussed later.

Between the bag 8 and the container 4 is a space 10. The underside 12 of container 4 has a filling port therein. This port is closed by plug 14 in FIGS. 2 and 3. It should be recognized that this plug 14 can be removed for filling the space 10 with pressurized gas. This pressurized gas may be carbon dioxide or any other suitable gas. When plug 14 is inserted into the filling port, the space 10 is substantially sealed except for opening 20.

This opening 20 is provided in retainer 18. Retainer 18 is a part of the means for affixing 15 the bag 8 to the container 4.

This means for affixing 15 comprises a plastic fitment or attachment spout 16 to which bag 8 is connected. Connected to attachment spout 16 is a retainer 18. This retainer 18 has the opening 20 which will be discussed in more detail below. The means for affixing 15 also includes cover 22. The cover 22 and retainer 18 are provided at the top portion of the rigid container 4. It should be understood that a single structure can be used to replace the two elements (retainer 18 and cover 22).

A threaded portion 24 is provided on cover 22. As seen in FIG. 2, the safety cap 6 has a mating threaded portion 26. In this manner, the cap 6 can be screwed onto the rigid container 4. It should be recognized that the cap 6 could also be snapped onto rigid container 4 or mounted thereto by other suitable means.

Cap 6 has a flange 28 at the lower end thereof. As seen in FIG. 2, this flange 28 closes an opening 30 in the cover 22. This opening 30 in cover 22 and the opening 20 in retainer 18 together form a passageway 31 for venting pressurized gas. The two openings 20 and 30 are generally aligned. Again, if a single element is used to replace the retainer 18 and cover 22, a single bore can be provided therethrough.

At the upper end of the passageway 31 is a vent hole 32. This vent hole is closed by the flange 28 on cap 6. While the cap 6 is shown with the flange encircling the lower end thereof, it should be understood that a single tab could be used. Specifically, when the cap 6 is screwed onto the rigid container 4, a protrusion can be provided at the lower end thereto instead of flange 28. This protrusion will be aligned over the vent hole 32 of the passageway 31 when the cap 6 is completely screwed on container 4. In this manner, the passageway 31 can be sealed. Other arrangements apart from flange 28 should be apparent to those skilled in the art.

The flange 28 will seal the vent hole 32 and Passageway 31 when the cap 6 is completely screwed onto the container 4. To further ensure sealing, an O-ring 34 can be provided. Other similar sealing arrangements can be used. Alternatively, the vent hole 32 can be solely sealed by the flange 28 or the like when the cap 6 is screwed onto container 4. At vent hole 32, an additional valve can be provided. This one-way valve will allow slow discharge of pressurized gas from the space 10 when safety cap 6 is removed from container 4. However, such a secondary valve is not required. Merely by removing cap 6 from container 4, the pressurized gas 10 will be gently vented through vent hole 32.

In FIGS. 2 and 3, a first embodiment of a valve 36 is shown. Pre-mix is charged and discharged from collapsible bag 8 through this valve 36. This valve 36 includes a drinking spout 37. An elastomeric seal/spring 38 is provided for valve 36. This elastomeric spring 38 is positioned between retainer 18 and cover 22. If a single element is used instead of retainer 18 and cover 22, then a recess or other attachment arrangement can be used for elastomeric spring 38.

As indicated in FIG. 3, a force (shown by arrow 40) can be used to push the drinking spout 37 partially into the rigid container 4. At the upper end of drinking spout 37 is a user engagement portion 42. When using the package, a consumer (such as an astronaut) can first remove cap 6, thereby venting pressurized gas from space 10 through passageway 31. The consumer then can place the end of drinking spout 37 into his or her mouth. The consumer's lips may engage portion 42. By forcing drinking spout 37 partially into rigid container 4, the elastomeric spring 38 will deform. This operation will open Pre-mix passageway 52 in spout 37 as will be described in more detail below.

On drinking spout 37, a protrusion 44 is provided. The elastomeric spring 38 engages the drinking spout 37 between the lower side of the user engagement portion 42 and this protrusion 44. At the lower end of drinking spout 37 is a closure 46. This closure 46 will engage ridge 48 of the elastomeric spring 38.

A plurality of openings 50 are shown at the lower end of pre-mix passageway 52 in drinking spout 37. While several passageways are shown, it should be understood that any suitable arrangement can be provided for creating a passageway through which pre-mix can be removed from the collapsible bag. For instance, the drinking spout 37 could be a generally solid structure with a series of continuous bores therethrough. Each bore would form a passageway through the drinking spout 37. One end of each passageway would terminate at the upper end of the drinking spout 37 and the opposite end would terminate adjacent openings 50. Other arrangements are possible as will be discussed in more detail below with reference to the second embodiment for the valve.

In use, a consumer can place the drinking spout 37 into their mouth to open valve 36. When the drinking spout 37 is partially pushed into the rigid container 4, the closure 46 will move away from ridge 48. In this manner, the elastomeric seal is broken, allowing the pre-mix to flow through holes 50 and pre-mix passageway 52 so that this pre-mix can be consumed. While it has been discussed that a consumer will place the container directly in their mouth, it should be understood that the consumer may simply place their fingers near user engagement portion 42 to force the drinking spout 37 partially into the rigid container 4. Then the pre-mix can be poured from the package 2. Such an arrangement can be used when the package 2 is used on earth as opposed to the zero or micro-gravity conditions of outer space. Implements can also be used for moving the drinking spout 37 from a closed to the open position.

The elastomeric spring 38 will enable the valve to automatically return to the closed position when force 40 is removed. The drinking spout 37 will move out of the rigid container 4 from the position shown in FIG. 3, returning to the position shown in FIG. 2 when this force 40 is released. The closure 46 on drinking spout 37 will again engage ridge 48 to seal the pre-mix package. Therefore, a consumer need not ingest all of the pre-mix at one time. If the user is finished for the time being and pre-mix remains in package 2, the safety cap 6 can be replaced on rigid container 4. In this manner, it can be assured that pre-mix will not accidentally spill from the package 2.

Figure 4:
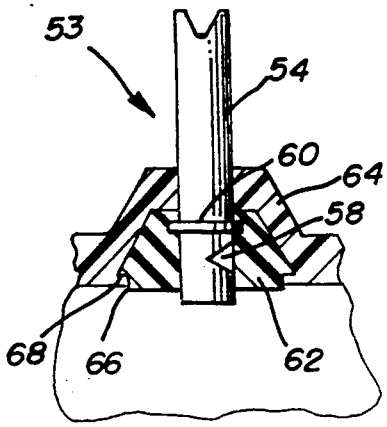
FIG. 4 is a second embodiment of the package of the instant invention with the cap removed and the valve in a closed position.
Figure 5:
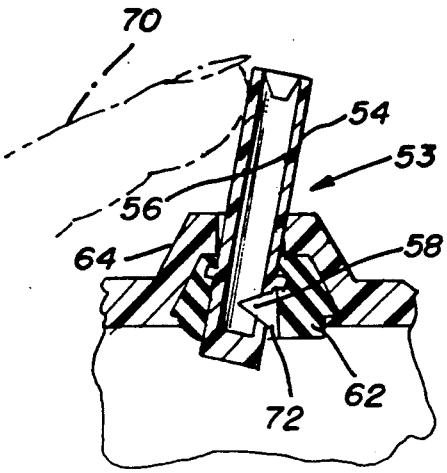
FIG. 5 is a cross-sectional view of the valve of FIG. 4 in the open position.

In FIGS. 4 and 5, a second embodiment for a valve 53 is shown. This arrangement is similar to a "whipped cream" type valve. In valve 53, a drinking spout 54 is provided. Premix passageway 56 extends through drinking spout 54. At the lower end of drinking spout 54 is an opening 58. As seen in FIG. 4, when the valve 53 is in the closed position, the opening 58 is sealed against a plug 62.

A ridge 60 is provided above the openings 58 of drinking spout 54. This ridge 60 engages plug 62 to securely hold the drinking spout 54 in plug 62. Plug 62 is positioned within a frusto-conically shaped projection 64 in the top of container 4. It should be recognized that other means for attaching the valve 53 can be provided. For example, the top surface of the container 4 can merely have a hole punched therein rather than being deformed to have projection 64. The valve 53 can be then inserted therein.

On the lower side of plug 62 is a recess 66 which receives a projection 68 of container 4. This interlocking arrangement helps to hold plug 62 in the frusto-conically shaped projection 64.

As indicated in FIG. 5, pressure can be applied to a side of drinking spout 54 by a finger 70. This pressure will cause drinking spout 54 to move in a pivoting manner whereby the lower end of spout 54 moves away from a side of plug 62 to form an opening 72. In this manner, pre-mix can travel through opening 72, opening 58 and the pre-mix passageway 56. When the finger 70 is removed, the drinking spout 54 will automatically return to the closed position as shown in FIG. 4.

It should be recognized that FIGS. 4 and 5 are simplified in order to show the valve 53. These arrangements are to be used with a safety cap 6. Therefore, means for affixing the cap 6 to container 4 are to be provided. Also, the collapsible bag 8 as well as the means for affixing this bag 8 to container 4 are not shown in these FIGS. 4 and 5.

Once the micro-gravity pre-mix package 2 has been assembled, it can easily be filled. First, the valve 36 or 53 is moved to an open position. Then, all air is evacuated from bag 8. Next, pre-mix is filled through the valve into collapsible bag 8. About six fluid ounces of carbonated pre-mix are filled in the bag at about 32° F. A very low pressure and a very low flow rate are used to avoid carbonation breakout during filling. After the collapsible bag 8 is filled, the valve 36 or 53 is released such that it will automatically move to the closed position. The cap 6 is then screwed onto container 4. Pressurized gas is introduced into the space 10 between collapsible bag 8 and rigid container 4 through a filling port. When a suitable amount of pressurized gas has been introduced, this filling port is closed by plug 14. This filling sequence can be carried out on earth.

The package 2 is then ready for use. It can be used on earth or in the micro-gravity conditions of outer space. The cap 6 will first be unscrewed from container 4. This operation automatically vents the pressurized gas from space 10 through passageway 31. The pressurized gas is gently vented from vent hole 32. The consumer can then put the end of the drinking spout 37 or 54 into their mouth. This arrangement should be used in the zero or micro-gravity conditions of outer space. Rather then placing the spout 37 or 54 into the consumer's mouth, the pre-mix can be poured from a container when used on earth as discussed above.

If the consumer places the end of spout 37 or 54 into their mouth, they can then move this spout. In the embodiment shown in FIGS. 2 and 3, the valve 36 will be partially inserted into container 4. In the embodiment of FIGS. 4 and 5, the valve 53 will merely pivot to an open position. The consumer will then suck the pre-mix out of the package 2. If all of the pre-mix is consumed, the package 2 can be disposed of. However, if some pre-mix remains in the package, the consumer merely needs to release the drinking spout 37 or 54. The valve 36 or 53 will automatically return to the closed position. If the remaining pre-mix is not to be consumed for some time, the cap 6 may be replaced on container 4. In that manner, it can be assured that pre-mix is not accidentally dispensed from the package 2.

While the cap 6 is shown as only being screwed onto container 4, it should be understood that a suitable connection or tether can be provided between cap 6 and container 4. For example, a string or plastic thread can be provided to keep the cap 6 within the area of container 4. Alternatively, a strip of "Velcro" may be provided to affix the removed cap 6 to the container 4. Such a strip of "Velcro" can also be provided on the container 4 to permit support of the container within the space craft.

Because the instant package 2 can be used in zero or micro-gravity conditions of outer space, it should be recognized that any reference to up or down or the like in the specification are merely with reference to the drawings. While the instant package 2 is suitable in the zero or micro-gravity conditions of outer space, this package is also suitable for use on earth.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A package for dispensing a carbonated beverage pre-mix comprising:

a rigid container;

a collapsible bag disposed within the rigid container, said bag containing the pre-mix and a space being defined between the bag and rigid container, the space housing a pressurized gas for keeping the carbonated beverage pre-mix in solution;

means for affixing the bag to the container, said means for affixing having a passageway defined therein connecting said space to ambient environment outside the package;

a valve mounted in said means for affixing in fluid communication with the interior of said bag, said valve being movable between an open position and a closed position, pre-mix from the bag being dischargeable from said package when the valve is moved to the open position; and a safety cap for enclosing the valve, said cap being positioned adjacent the means for affixing and covering the passageway when the cap encloses the valve, said cap being removable for discharge of the pre-mix through the valve, the pressurized gas in the space being discharged in response to removal of the cap from the means for affixing, enabling subsequent discharge of the pre-mix from the collapsible bag when the valve is moved to the open position.

2. The package as recited in claim 1, wherein the cap has a flange and the flange covers and seals the passageway when the cap encloses the valve to thereby close the passageway, the passageway being open by removal of the flange whereby the pressurized gas is released from the space through the passageway.

3. The package as recited in claim 2, wherein an O-ring is provided at an end of the passageway adjacent the flange to aid in sealing the passageway when the cap encloses the valve.

4. The package as recited in claim 2, wherein the means for affixing comprises at least a cover and a retainer, the cap being engageable with the cover and the valve being mounted between the cover and retainer, said cover and said retainer both having openings defined therein, the openings being generally aligned and forming said passageway, an end of the opening in the cover forming a vent hole, the flange of the cap sealing the vent hole when the cap encloses the valve.

5. The package as recited in claim 1, wherein the means for affixing comprises at least a cover and a retainer, the cap being engageable with the cover and the valve being mounted between the cover and retainer, said cover and retainer both having openings defined therein, the openings being generally aligned and forming said passageway, an end of the opening in the cover forming a vent hole which is sealed by the cap when the cap encloses the valve.

6. The package as recited in claim 5, wherein the means for affixing further comprises an attachment spout, the collapsible bag being affixed to the attachment spout and the attachment spout being mounted on the retainer, the space housing the pressurized gas being generally defined by an interior wall of the rigid container, an exterior side of the bag, the attachment spout and the retainer.

7. The package as recited in claim 1, wherein the rigid container has a port defined therein for admitting the pressurized gas to the space, the package further comprises a plug for closing said port.

8. The package as recited in claim 1, wherein the valve comprises a drinking spout and an elastomeric spring, the spring being mounted to the means for affixing and the drinking spout being positioned in the elastomeric spring, the drinking spout being movable between the open and closed positions.

9. The package as recited in claim 8, wherein the drinking spout has a closure on one end thereof and has a pre-mix passageway defined therethrough for discharging pre-mix from the collapsible bag when the drinking spout is in the open position, the closure on the drinking spout engaging a portion of the elastomeric spring when the drinking spout is in the closed position, thereby sealing the pre-mix passageway from the collapsible bag to prevent discharge of the pre-mix.

10. The package as recited in claim 9, wherein the elastomeric spring is deformable between first and second positions, the drinking spout being closed and opened when the elastomeric spring is in the first and second positions, respectively, the elastomeric spring urging the drinking spout to the closed position when the elastomeric spring is in the second position.

11. The package as recited in claim 8, wherein the drinking spout has a pre-mix passageway defined therein, a user engagement portion, a protrusion and a closure, the elastomeric spring being mounted to the drinking spout between the user engagement portion and the protrusion, and the closure engaged with a portion of the elastomeric spring when the drinking spout is in the closed position to thereby seal the pre-mix passageway from the collapsible bag, the user engagement portion being contacted by a user who forces the drinking spout toward the collapsible bag to thereby deform the elastomeric spring and move the closure away from the portion of the elastomeric spring, thereby enabling discharge of the carbonated beverage pre-mix from the package.

12. The package as recited in claim 11, wherein the user engagement portion engages lips of the user who sucks the carbonated beverage pre-mix from the package upon moving the drinking spout to the open position, the valve having a length of drinking spout between an end thereof and the user engagement portion to accommodate the lips of the user.

13. The package as recited in claim 12, wherein the passageway for discharge of pressurized gas is located a predetermined distance from the drinking spout such that a user fails to contact the passageway when consuming the pre-mix from the package.

14. The package as recited in claim 8, wherein the means for affixing comprises a cover, the cover having a raised portion for engaging the cap, the raised portion of the cover being positioned between the drinking spout and the passageway for discharge of pressurized gas.

15. The package as recited in claim 1, wherein the rigid container has a frusto-conically shaped projection and wherein the valve comprises a drinking spout and a plug, the plug being positioned in the frusto-conically shaped projection and the drinking spout extending through the plug, said drinking spout having a pre-mix passageway for discharging pre-mix from the collapsible bag, the drinking spout being movable between the open and closed position to respectively open and close the pre-mix passageway.

16. The package as recited in claim 1, wherein the package is for use in the micro-gravity conditions of outer space and wherein the cap further comprises a flange for sealing the passageway when the cap encloses the valve to prevent discharge of the pressurized gas from the space between the collapsible bag and the rigid container.

17. A method for dispensing a carbonated beverage pre-mix from a package in micro-gravity conditions of outer space, comprising the steps of:

providing a rigid container with a collapsible bag therein, said collapsible bag containing the pre-mix and a space being defined between the bag and rigid container, the space housing a pressurized gas;

maintaining the carbonated beverage pre-mix in the bag in solution by the pressurized gas in the space;

removing a cap from the rigid container to expose a valve in the rigid container, said valve being in fluid communication with the interior of said collapsible bag and being in a closed position, a pre-mix passageway in the valve being sealed when the valve is in the closed position;

venting the pressurized gas from the space in response to the step of removing the cap;

moving the valve from the closed to an open position after the step of venting to thereby open the pre-mix passageway; and discharging the carbonated beverage pre-mix from the collapsible bag through the open pre-mix passageway.

18. The method for dispensing as set forth in claim 17, further comprising the steps of:

returning the valve from the open to the closed position to reseal the pre-mix passageway; and replacing the cap on the rigid container after the step of returning.

19. The method for dispensing as set forth in claim 17, wherein the step of moving comprises the step of pushing the valve partially into the rigid container and the step of discharging comprises the step of sucking the pre-mix from the package through the pre-mix passageway.

20. The method for dispensing as set forth in claim 17, further comprising the step of filling the package which comprises the following steps;

moving the valve to the open position provided the rigid container is free of the cap;

removing the air from the bag;

filling the collapsible bag through the pre-mix passageway with carbonated beverage pre-mix when the valve is in the open position;

releasing the valve after the step of filling whereby the valve returns to the closed position;

placing the cap on the rigid container;

injecting the pressurized gas into the space between the bag and rigid container through a filling port in the rigid container; and closing the filling port to thereby seal the pressurized gas in the space.

* * * * *